US006005234A

United States Patent [19]

Moseley et al.

[11] Patent Number: 6,005,234

[45] Date of Patent: Dec. 21, 1999

[54] MICROWAVE POPCORN BAG WITH CROSS MITRE ARRANGEMENT

[75] Inventors: Jennifer D. Moseley, LaFontaine; John C. Little, Fort Wayne, both of Ind.

[73] Assignee: Weaver Popcorn Company, VanBuren, Ind.

[21] Appl. No.: 09/126,457

[22] Filed: Jul. 30, 1998

[51] Int. Cl.[6] ..... H05B 6/80

[52] U.S. Cl. ..... 219/727; 383/104; 383/121; 426/241

[58] Field of Search ..... 219/727, 730, 219/735; 426/241, 243, 234, 107; 383/104, 121

[56] References Cited

U.S. PATENT DOCUMENTS

| | | | |
|---|---|---|---|
| Re. 34,683 | 8/1994 | Maynard et al. | 219/703 |
| 2,595,708 | 5/1952 | Salfisberg | 206/46 |
| 2,633,284 | 3/1953 | Moffett et al. | 229/2.5 |
| 3,873,735 | 3/1975 | Chalin et al. | 426/87 |
| 3,973,045 | 8/1976 | Brandberg et al. | 426/110 |
| 4,450,180 | 5/1984 | Watkins | 426/107 |
| 4,548,826 | 10/1985 | Watkins | 426/394 |
| 4,691,374 | 9/1987 | Watkins et al. | 383/104 |
| 4,806,371 | 2/1989 | Mendenhall | 426/113 |
| 4,808,421 | 2/1989 | Mendenhall et al. | 426/107 |
| 4,851,246 | 7/1989 | Maxwell et al. | 426/107 |
| 4,874,620 | 10/1989 | Mendenhall et al. | 426/113 |
| 4,883,936 | 11/1989 | Maynard et al. | 219/10.55 |
| 4,890,439 | 1/1990 | Smart et al. | 53/410 |
| 4,970,358 | 11/1990 | Brandberg et al. | 219/10.55 |
| 4,973,810 | 11/1990 | Brauner | 219/10.55 |
| 5,044,777 | 9/1991 | Watkins et al. | 383/100 |
| 5,075,119 | 12/1991 | Mendenhall | 426/113 |
| 5,081,330 | 1/1992 | Brandberg et al. | 219/10.55 |
| 5,171,594 | 12/1992 | Babbitt | 426/107 |
| 5,175,031 | 12/1992 | Ochocki | 428/34.2 |

FOREIGN PATENT DOCUMENTS

| | | |
|---|---|---|
| 81544 | 12/1956 | Germany . |
| 2202118 | 9/1988 | United Kingdom . |

(List continued on next page.)

*Primary Examiner*—Philip H. Leung
*Assistant Examiner*—Shawntina Fuqua
*Attorney, Agent, or Firm*—Baker & Daniels

[57] ABSTRACT

The present invention involves a microwave popcorn bag adapted to contain a plurality of popcorn kernels to be heated and popped by the application of microwave energy. The microwave popcorn bag is formed from a sheet of material comprising a front panel, a back panel, and first and second gussets connected to the front and back panels along gusset edges all of which form an interior popping space. The first and second gussets are folded along a centerline forming first and second gusset panels. The bottom seal is located on a lower edge and is capable of sealing the lower edge of the bag during the popping of the popcorn kernels. A miter is located proximate the bottom seal and includes an edge strip extending from about said bottom seal along one of the gusset edges for a length corresponding to about the length of a gusset panel. The miter includes a cross strip extending for a length corresponding to about the length of a gusset panel. The cross strip intersects the edge strip at about the midpoint of the edge strip. The top seal is located on an upper edge and is capable of sealing the upper edge of the bag during the popping of the popcorn kernels and further capable of allowing manual opening of the bag after the popping of the popcorn kernels. The top seal further comprises a top miter formed between the back panel and one of the gussets having a generally triangular shape, providing controlled venting of the bag interior during popcorn popping. The miters generally comprise an adhesive material. A plurality of miters are disposed on each of the edges between the front and back panels and the gussets. A susceptor material is disposed on a region of the front panel extending substantially the length of the front panel between the gussets. When exposed to microwave radiation, the susceptor region provides heating to substantially all portions of the interior popping space.

28 Claims, 2 Drawing Sheets

U.S. PATENT DOCUMENTS

| | | | |
|---|---|---|---|
| 5,195,829 | 3/1993 | Watkins et al. | 383/100 |
| 5,211,975 | 5/1993 | Mendenhall et al. | 426/107 |
| 5,217,768 | 6/1993 | Walters et al. | 428/35.8 |
| 5,294,765 | 3/1994 | Archibald et al. | 219/727 |
| 5,302,790 | 4/1994 | Turpin | 219/727 |
| 5,306,512 | 4/1994 | Blamer | 426/107 |
| 5,317,118 | 5/1994 | Brandberg et al. | 219/727 |
| 5,326,576 | 7/1994 | Zuege | 426/107 |
| 5,350,904 | 9/1994 | Kemske et al. | 219/730 |
| 5,399,022 | 3/1995 | Sheets | 383/103 |
| 5,424,517 | 6/1995 | Habeger, Jr. et al. | 219/728 |
| 5,460,839 | 10/1995 | Archibald | 426/107 |
| 5,464,969 | 11/1995 | Miller | 219/735 |
| 5,474,383 | 12/1995 | Zuege et al. | 383/121 |
| 5,650,084 | 7/1997 | Bley | 219/727 |
| 5,690,853 | 11/1997 | Jackson et al. | 219/727 |
| 5,786,010 | 7/1998 | Yannuzzi, Jr. | 426/107 |
| 5,814,382 | 9/1998 | Yannuzzi, Jr. | 428/34.3 |

MICROWAVE POPCORN BAG WITH CROSS MITRE ARRANGEMENT

FIELD OF THE INVENTION

The invention generally relates to the field of cooking articles for microwave ovens. More specifically, the field of the invention is that of microwave popcorn bags.

DESCRIPTION OF THE RELATED ART

Various items of food have been adapted for cooking in microwave ovens, and popcorn has become one of the most popular microwavable foods. Early attempts at cooking popcorn in a microwave oven involved using a shape similar to paper lunch bag with a rectangular bottom. However, this type of bag did not work well with allowing the popcorn kernels to expand and fill the bag. Also, often many kernels were left unpopped because of inadequate conveyance of heat to all the popcorn kernels. New bags were then developed which made two major changes.

The first change was in the shape of the bag itself, going from the rectangular bottom to a pillow shape, pinch bottom which provides more room for the popcorn kernels to expand and fill the bag. The pillow shaped bag is generally comprised of a front and back panel which are connected by lengthwise gussets and which are sealed on the top and bottom. The bottom seal must be sufficient to withstand the pressures of heating and popping the popcorn and oil charge, although the top seal may have some weakness to allow for venting of the bag during popping, and for easy manual opening by the consumer pulling apart the top of the panels.

The second change involved increasing the heat present in the bag by adding a microwave susceptor patch with the bag, located over the location of the popcorn and oil charge within the bag. Also, to prevent leakage of oil from the bag, the paper layers include a grease resistant layer to prevent melted oil from soaking the outer paper layers of the bag. The construction of the bag includes two plies of paper, with the microwave susceptor patch being located and registered between the two plies. The microwave susceptor material was thus located between the grease resistant layer on the inside of the bag and the printing layer located on the outside of the bag. Both of these changes improved the performance of microwave popcorn bags.

These changes also had drawbacks. The pillow shaped bag, while better adapted to expand during the initial popping of the bag, ultimately restricts the amount of space available within the interior of the bag. Also, locating and registering the microwave susceptor material at the appropriate location on the bag stock creates an additional manufacturing step, slowing and complicating the manufacturing process. The proper location of the susceptor material relative to the popcorn kernels is crucial to achieving high popping efficiency by providing adequate amounts of heat to the popcorn kernels located within the interior space of the bag.

Advances in the pillow shaped bag attempt to create a rectangular bottom portion on the pillow shaped bag as a result of the popping. By glueing together certain portions of the bottom and top portions of the bag, the bottom and top portion tend to form a flatter, more rectangular end compared to a pillow shaped bag which is only glued at the end seals. Several different arrangements of gluing are used, having varying locations and amounts of glue for creating the flatter, rectangular ends. However, the microwave popcorn industry still desires a bag which when popped provides improved internal volume, accomplished with the flatter, rectangular ends, while minimizing the material and manufacturing costs.

SUMMARY OF THE INVENTION

The present invention utilizes a cross shaped mitre design on the gussets of a microwave popcorn bag proximate the bottom end to provide the desired flatter, rectangular bottom with a minimum of material cost and manufacturing complication. The cross shaped mitre design recognizes that the size and position of the mitre is directly related to the dimensions of the gussets. Thus, the extent of the cross shape is commensurate with the width of the gussets. The mitres include a first strip of adhesive which extends from the bottom seal of the microwave popcorn bag along the fold connecting the gussets and front and back panels, respectively, of the microwave popcorn bag. A second strip of adhesive crosses the first strip about at the midpoint of the first strips and extends the same width as the width of the gussets.

The size of the mitre of the present invention uses less material than prior art arrangements. When a microwave popcorn bag filled with popcorn and oil is subjected to microwave energy, the heating of the oil generates steam which causes the bag to expand and provide space for the popping of the popcorn kernels . Conventionally, an end sealed bag forms a pillow shaped bag upon such heating and popping. With the mitre design of the present invention, the bottom end of the microwave popcorn bag tends to form a rectangular shaped bottom surface, which increases the total space inside the bag for the popped kernels.

Another aspect of the invention involves the top end seal. Conventionally, heated gases are vented through the top end of the microwave popcorn bag. The present invention improves this characteristic by forming a top mitre arrangement to control the venting while increasing the interior space for popping kernels. The top mitre tends to form a squared off shape when the bag expands due to heated gases. Venting through the top end seal is also controlled by strengthening the initial resistance to the increased pressure inside the microwave popcorn bag, regulating the escape of such heated gases through the partially ruptured top seal. Regulating the escape of the heated gases from inside the microwave popcorn bag also enhances the flavor delivered to the popped kernels.

The present invention, in one form, involves a microwave popcorn bag adapted to contain a plurality of popcorn kernels to be heated and popped by the application of microwave energy. The microwave popcorn bag is formed from a sheet of material which comprises a front panel, a back panel, and first and second gussets. The gussets are connected to the front panel and back panel along gusset edges. The gussets are folded along a centerline forming first and second gusset panels. A bottom seal is located on a lower edge of the sheet of material, and is capable of keeping the lower edge of the bag sealed during popping of the popcorn kernels. A mitre is located proximate the bottom seal and has an edge strip and a cross strip. The edge strip extends from about the bottom seal along one of the gusset edges for a length corresponding to about the length of the gusset panel. The cross strip extends for a length corresponding to about the length of the gusset panel. The cross strip intersects the edge strip at about the midpoint of the edge strip.

One object of the present invention is to provide an improved microwave popcorn bag which enhances the amount of kernels that can be popped.

Another object of the invention is to provide an improved microwave popcorn bag which decreases the material and processing costs of manufacture.

A further object of the invention is to provide an improved microwave popcorn bag that controls the venting of steam during the microwave cooking process.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
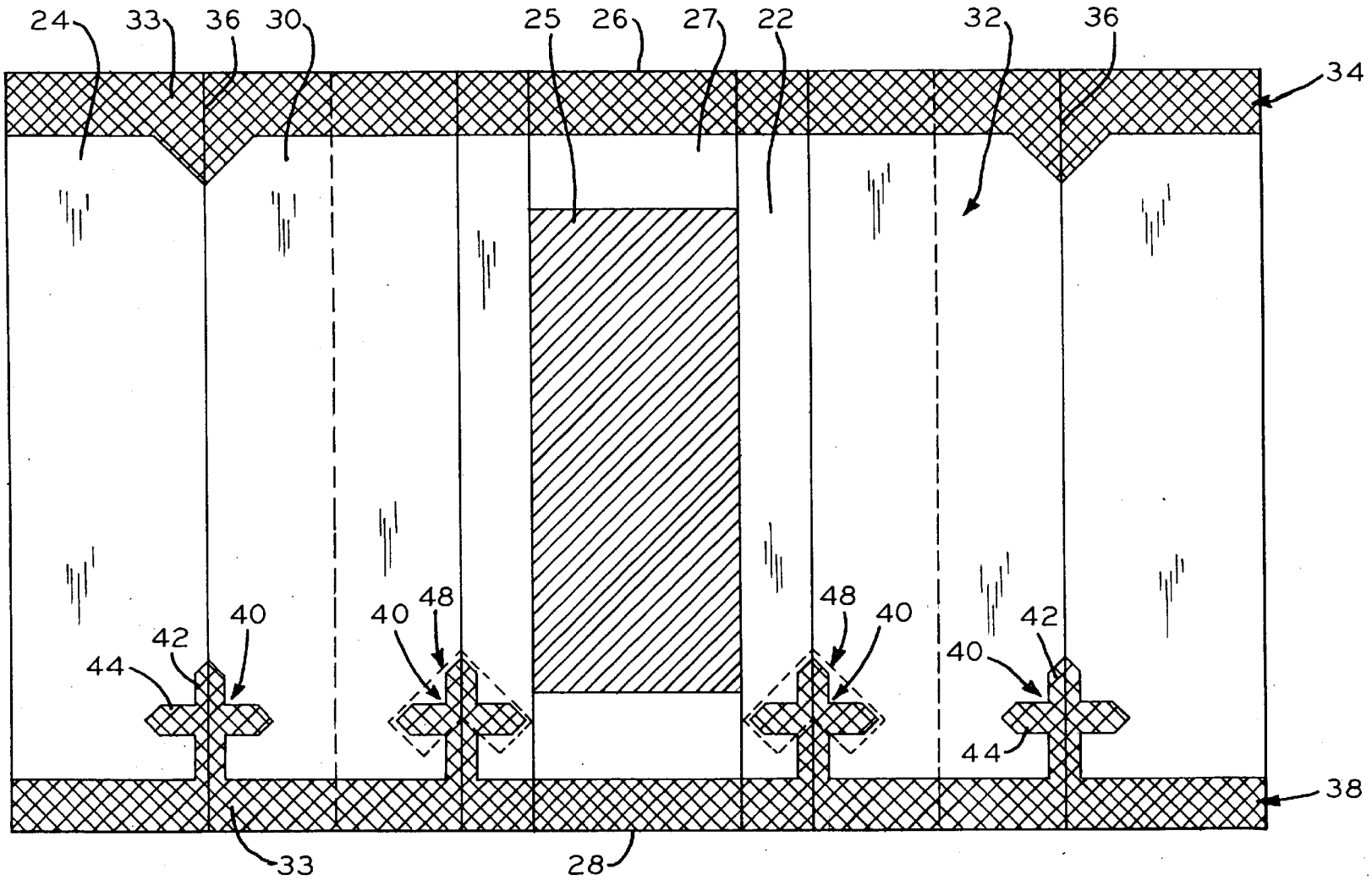
FIG. 1 is a plan view of a microwave popcorn bag of the present invention previous to folding and sealing.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DESCRIPTION OF THE PRESENT INVENTION

The embodiment disclosed below is not intended to be exhaustive or limit the invention to the precise form disclosed in the following detailed description. Rather, the embodiment is chosen and described so that others skilled in the art may utilize its teachings.

The mitre design of the present invention is shown previous to the folding of the microwave popcorn bag in FIG. 1. Bag 20 comprises a sheet of material which includes front panel 22 and back panel 24. Front panel 22 includes microwave susceptor material 25 to enhance the heating of popcorn kernels within the bag when subjected to microwave energy. In the disclosed embodiment, microwave susceptor material 25 extends nearly continuously from top edge 26 to bottom edge 28 with the susceptor material being located on strip 27 of polymer material integrally and continuously formed within the sheet of material. Back panel 24 is initially two portions which are connected together by a manufacturer's joint in a manner well known in this art. Gussets 30 and 32 connect front and back panels 22 and 24 and are folded at the center.

Previous to folding the sheet of material, adhesive material 33 is applied at selected areas of the material. Adhesive material forms both top edge seal 34 and top mitre 36 along top edge 26, and bottom edge seal 38 along bottom edge 28. In the exemplary embodiment, top edge seal 34 extends about 1.0625 inches from top edge 26, and bottom edge seal 38 extends about 0.75 inches above bottom edge 28. That adhesive material also forms the mitre design of the present invention at mitres 40. The adhesive material is first dried on the stock material before the stock material is rolled together. The adhesive material is also heat activated, and the roto gravure method of applying the heat seal adhesive has been used for attaining better accuracy, while the flexo graphic method may alternatively be used. Such adhesive material may include such substances as polyvinyl acetate homopolymer emulsions or polyvinyl acetate homopolymer emulsions with additives to enhance machinability according to specific situations and requirements. Alternatively, other adhesives may be used which have similar qualities such as creating strong bonds with a minimum application coating weight and being able to be sealed within a wide range of temperatures, which are beneficial in accomplishing the objectives of the present invention. For visibility purposes, the adhesive material may be colored with a dye.

The sealing of adhesive material 33 is realized by pressing a metal bar into the stock and adhesive material against a rubber type backing material. The rubber type backing material "gives" as the metal is compressing the stock material, thus minimizing any pressure variation across the seal due to varying thickness of the stock material. Additionally, a horizontal "hill and valley" pattern is used on the end seal areas which appears to minimize the risk that liquified, free flowing oil may leak out of the sealed bag at the end seal areas. This seal structure is better able to handle the internal bag pressures during popping of popcorn kernels.

In the exemplary embodiment of the invention, mitres 40 include edge strip 42 and cross strip 44. Each edge strip 42 extends about two inches from bottom edge seal 38, terminating in a right angle point. Each cross strip 44 extends through the midpoint of edge strip 42 and also extends about two inches, with each end terminating in a right angle point. Each pair of mitres 40 located on a common gusset are matched so that the portion of each mitre 40 located on gusset 30 or 32 overlays on the other mitre 40 located on the other side of the corresponding gusset. Each of edge strips 42 and cross strips 44 have a width of about one half inch. This configuration is related to the dimensions of gussets 30 and 32 which are about four inches wide, with each panel of gussets 30 and 32 being about two inches wide. In the exemplary embodiment, the front and back panels are about five and one half inches wide.

Mitres 40 act to create a "squared off" bottom portion of bag 20 when an assembled bag has its kernels popped. Specifically, the adhesion created by the sealing of mitres 40 keeps triangular regions of laminar material remove together as bag 20 expands. As front panel 22 and back panel 24 are separated by the steam and popping kernels inside bag 20, gussets 30 and 32 unfold and flatten. The separation of panel 22 and 24 along with the flattening of gussets 30 and 32 draw in the portions of bag 20 forming bottom seal 38. The adhesion of the triangular regions allows the portions adjacent to bottom seal 38 to flatten, thus "squaring off" the bottom of bag 20. This arrangement provides an optimal amount of space for the popping of popcorn kernels by allowing maximum separation of front and back panels 22 and 24. Also, the "squared off" shape provides additional convenience by allowing bag 20, in its expanded condition, to stand upright on the flatten bottom of bottom edge seal 38. To further strengthen the integrity of bottom edge seal 38, exterior portions of gussets 30 and 32 near bottom edge seal 38 may be held together by adhesive.

Top mitres 36 are formed only on the edges of back panel 24 and gussets 30 and 32. In the exemplary embodiment, mitres 36 extend as a generally triangular shape about 0.8125 inches below top edge seal 34, forming an angle of about 94°. Top mitre 36 is sufficient for generally flattening the upper portion of bag 20 during popping, to the extent possible given the venting structure which is conventionally formed within top edge seal 34. This provides a squared off top of the bag, similar to the bottom after popping. Additionally, that squaring off strengthens the resistance of top edge seal 34 to the building internal pressure and limits the amount of venting allowed through top edge seal 34, improving the popping efficiency by retaining heat within the bag and keeping in any airborne flavorings in contact with the popped kernels rather than escaping from the bag.

Figure 2:
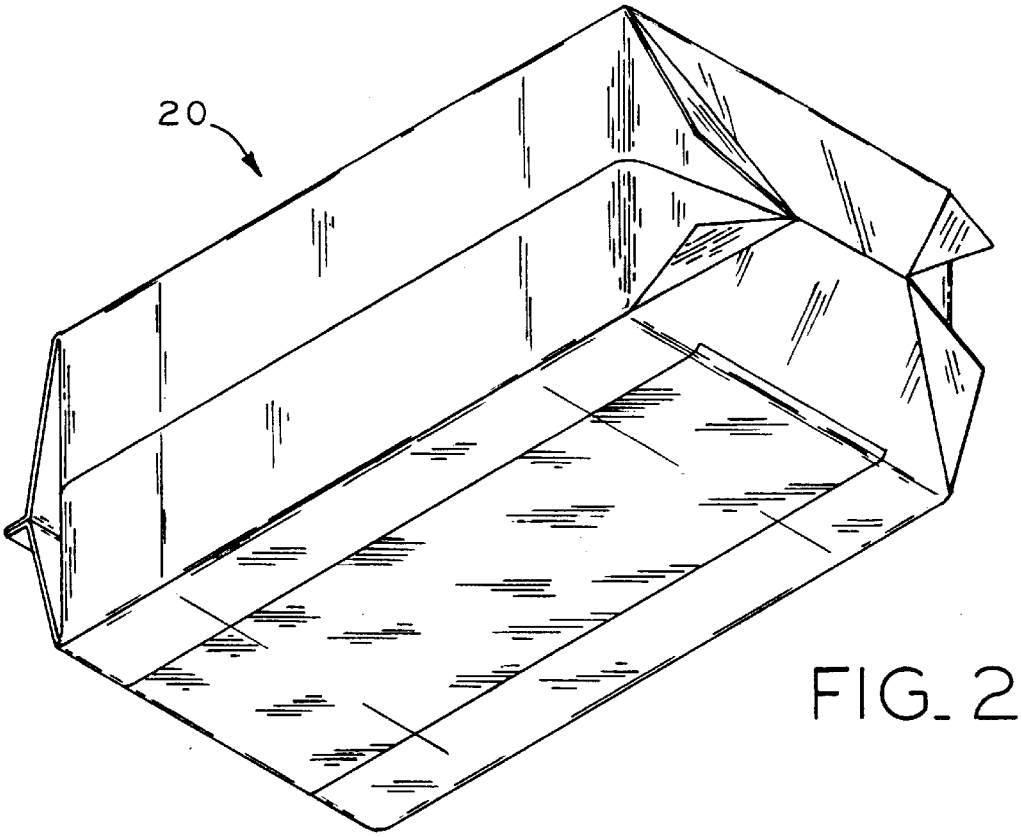
FIG. 2 is a perspective view of the top end of a microwave popcorn bag of the present invention after the popping of popcorn kernels.
Figure 3:
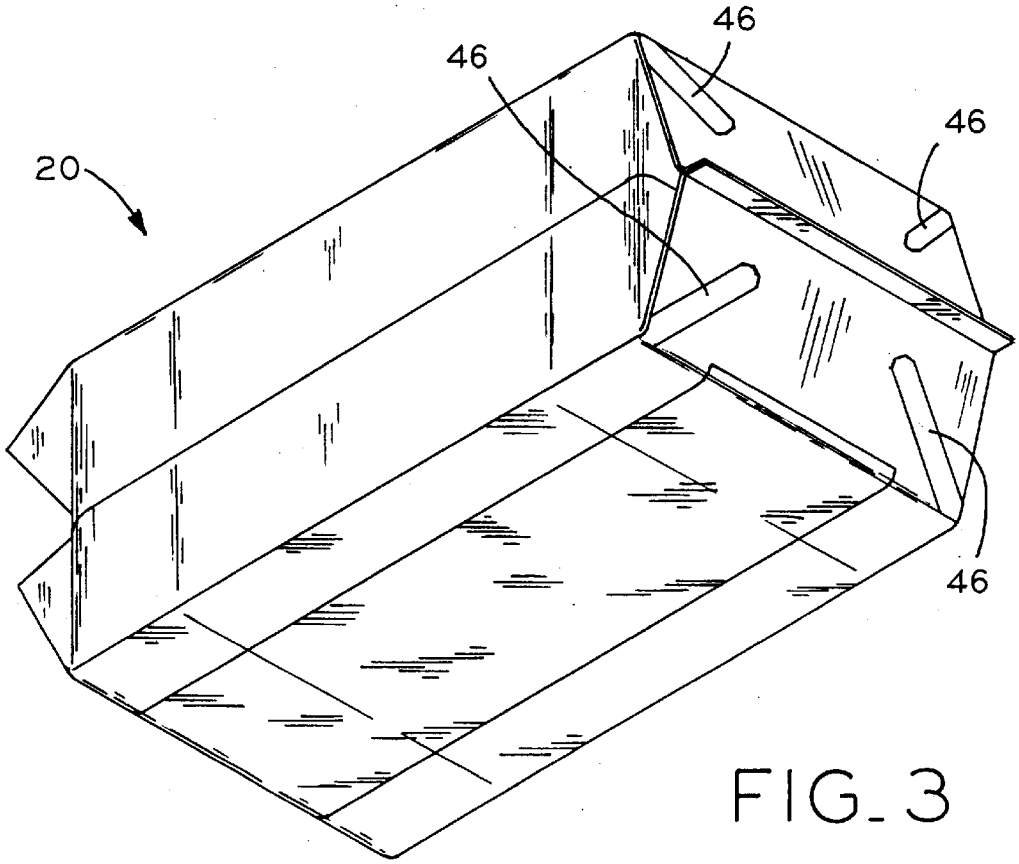
FIG. 3 is a perspective view of the bottom end of a microwave popcorn bag of the present invention after the popping of popcorn kernels.

After popping, bag 20 has the general configuration shown in FIGS. 2 and 3. Bottom edge seal 38 and bottom mitres 40 operate to "square off" the bottom portion of bag 20, forming a substantially rectangular bag bottom as shown in FIG. 3. Top edge seal 34 and top mitres 36 creates a substantial "squaring off" of the top portion of bag 20, which facilitates manual opening by pulling apart the portions of bag 20 bonded together by top edge seal 34 as shown in FIG. 2. Testing of the popped volumes of the bag of the present invention showed a significant increase in interior space compared to similarly sized bags using conventional designs. The resulting rectangular solid shape of the microwave popcorn bag maximizes the amount of interior room for popped kernels, so that the bag can contain the maximum possible amount of popped corn. Also, by limiting the amount of venting through the top edge popping efficiency is promoted because of the retention of heat with the additional benefit of maintaining the contact of airborne flavorings with the popped kernels.

Substantially all of the advantages of the present invention are achieved by utilizing a manufacturing process that activates a portion of the cross mitre arrangement provided on the sheet material. FIG. 3 shows press regions 46 which are formed by heated seal bars which press together and activate adhesive regions through the application of heat. In the exemplary embodiment, solid metal heated bars press gussets 30 and 32 and a portion of front and back panels 22 and 24, respectively, against a rubber pad. The heated pressing on press regions 46 activate a generally "L-shaped" region of adhesive which is shown on FIG. 1 as region 48. L-shaped region 48 are located above bottom seal 38 such that the corner of the L is spaced from bottom seal 38 by about the distance of either segment of strip 42 or 44 which form the L, and when activated creates a bonded region which holds together gussets 30 and 32 with those respective portions of front and back panels 22 and 24 to thus force the shaped remove bag 20 to expand to the substantially rectangular solid shape.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A microwave popcorn bag adapted to contain a plurality of popcorn kernels to be heated and popped when subjected to microwave energy, said microwave popcorn bag formed from a sheet of material comprising:

a front panel;

a back panel;

first and second gussets connected to said front panel and said back panel along gusset edges, said first and second gussets folded along a centerline forming first and second gusset panels;

a bottom seal located on a lower edge of said sheet of material, said bottom seal capable of sealing said lower edge of said bag during the popping of the popcorn kernels; and a mitre extending from said bottom seal, said mitre including an edge strip of adhesive extending along one of said gusset edges, said mitre including a cross strip of adhesive extending for a length corresponding to the length of one of said first and second gusset panels, said adhesive cross strip intersecting said adhesive edge strip at the midpoint of said adhesive edge strip.

2. The microwave popcorn bag of claim 1 further comprising a top seal located on an upper edge of said sheet of material, said top seal capable of sealing said upper edge of said bag during the popping of the popcorn kernels and further capable of allowing manual opening of said bag after the popping of the popcorn kernels.

3. The microwave popcorn bag of claim 2 wherein said top seal further comprises a top mitre formed between said back panel and one of said gussets.

4. The microwave popcorn bag of claim 3 wherein said top mitre has a generally triangular shape.

5. The microwave popcorn bag of claim 3 wherein said front panel includes a microwave susceptor material.

6. The microwave popcorn bag of claim 1 wherein said mitres generally comprise a heat activated adhesive material.

7. The microwave popcorn bag of claim 6 wherein said adhesive material is made from material including a polyvinyl acetate homopolymer emulsion.

8. The microwave popcorn bag of claim 7 wherein said adhesive material further includes an additive.

9. The microwave popcorn bag of claim 1 further comprising a plurality of said mitres, wherein said front and back panels abut said first and second gussets at a plurality of edges, said mitres disposed on said edges.

10. The microwave popcorn bag of claim 1 wherein said front panel includes a region of microwave susceptor material.

11. The microwave popcorn bag of claim 1 wherein said microwave susceptor material extends substantially across said front panel.

12. The microwave popcorn bag of claim 1 wherein said microwave susceptor material region is exclusive of said bottom seal.

13. The microwave popcorn bag of claim 1 wherein said adhesive edge strip extends for a length corresponding to about the length of one of said first and second gusset panels.

14. The microwave popcorn bag of claim 1 wherein said adhesive edge strip extends from said bottom seal.

15. A sheet of laminar material adapted to be folded to form a microwave popcorn bag adapted to contain a plurality of popcorn kernels to be heated and popped when subjected to microwave energy, said sheet of laminar material comprising:

a portion adapted to define a front panel;

a portion adapted to define a back panel;

portions adapted to define first and second gussets connected to said front panel and said back panel along gusset edges, said first and second gussets adapted to be folded along a centerline forming first and second gusset panels;

a bottom seal located on a lower edge of said sheet of laminar material, said bottom seal capable of sealing said lower edge of said bag during the popping of the popcorn kernels; and a mitre extending from said bottom seal, said mitre including an edge strip of adhesive extending along one of said gusset edges, said mitre including a cross strip of adhesive extending for a length corresponding to the length of one of said first and second gusset panels, said adhesive cross strip intersecting said adhesive edge strip at the midpoint of said adhesive edge strip.

16. The sheet of laminar material of claim 15 further comprising a top seal located on an upper edge of said sheet of material, said top seal capable of sealing said upper edge of said bag during the popping of the popcorn kernels and further capable of allowing manual opening of said bag after the popping of the popcorn kernels.

17. The sheet of laminar material of claim 16 wherein said top seal further comprises a top mitre formed between said back panel and one of said gussets.

18. The sheet of laminar material of claim 17 wherein said top mitre has a generally triangular shape.

19. The microwave popcorn bag of claim 17 wherein said front panel includes a microwave susceptor material.

20. The sheet of laminar material of claim 1 wherein said mitres generally comprise a heat activated adhesive material.

21. The sheet of laminar material of claim 20 wherein said adhesive material is made from material including a polyvinyl acetate homopolymer emulsion.

22. The sheet of laminar material of claim 21 wherein said adhesive material further includes an additive.

23. The sheet of laminar material of claim 15 further comprising a plurality of said mitres, wherein said front and back panels abut said first and second gussets at a plurality of edges, said mitres disposed on said edges.

24. The sheet of laminar material of claim 15 wherein said front panel includes a region of microwave susceptor material.

25. The sheet of laminar material of claim 15 wherein said microwave susceptor material extends substantially across said front panel.

26. The sheet of laminar material of claim 15 wherein said microwave susceptor material region is exclusive of said bottom seal.

27. The sheet of laminar material of claim 15 wherein said adhesive edge strip extends for a length corresponding to about the length of one of said first and second gusset panels.

28. The sheet of laminar material of claim 15 wherein said adhesive edge strip extends from said bottom seal.

* * * * *